US008833432B2

(12) United States Patent
Waniuk et al.

(10) Patent No.: US 8,833,432 B2
(45) Date of Patent: Sep. 16, 2014

(54) INJECTION COMPRESSION MOLDING OF AMORPHOUS ALLOYS

(71) Applicant: Apple Inc., Cupertino, CA (US)

(72) Inventors: Theodore A. Waniuk, Lake Forest, CA (US); Joseph Stevick, North Tustin, CA (US); Sean O'Keeffe, San Francisco, CA (US); Dermot J. Stratton, San Francisco, CA (US); Joseph C. Poole, San Francisco, CA (US); Matthew S. Scott, Campbell, CA (US); Christopher D. Prest, San Francosco, CA (US)

(73) Assignee: Apple Inc., Cupertino, CA (US)

( * ) Notice: Subject to any disclaimer, the term of this patent is extended or adjusted under 35 U.S.C. 154(b) by 0 days.

(21) Appl. No.: 13/628,262

(22) Filed: Sep. 27, 2012

(65) Prior Publication Data

US 2014/0083640 A1 Mar. 27, 2014

(51) Int. Cl.

| | |
|---|---|
| ***B22D 17/20*** | (2006.01) |
| ***B22D 17/22*** | (2006.01) |
| ***B22D 17/32*** | (2006.01) |
| ***B22D 27/11*** | (2006.01) |
| ***B22D 18/02*** | (2006.01) |

(52) U.S. Cl.

CPC ..... *B22D 17/2069* (2013.01); *B22D 17/32* (2013.01); *B22D 27/11* (2013.01); *B22D 18/02* (2013.01)

USPC ..... 164/113; 164/120

(58) Field of Classification Search

CPC .... B22D 17/2069; B22D 18/02; B22D 27/11; B22D 17/04; B22D 17/32; B29C 45/561

USPC ..... 164/113, 120, 136; 264/328.16

See application file for complete search history.

(56) References Cited

U.S. PATENT DOCUMENTS

| | | | |
|---|---|---|---|
| 3,731,727 | A | 5/1973 | Mitamura et al. |
| 4,049,041 | A | 9/1977 | Nikolov et al. |

(Continued)

FOREIGN PATENT DOCUMENTS

| | | |
|---|---|---|
| EP | 0845316 | 6/1998 |
| EP | 1013363 | 6/2000 |

(Continued)

OTHER PUBLICATIONS

JPO machine translation of JP 2006-289466, Oct. 26, 2006.*

(Continued)

*Primary Examiner* — Keith Walker
*Assistant Examiner* — Kevin E Yoon
(74) *Attorney, Agent, or Firm* — Pillsbury Winthrop Shaw Pittman LLP

(57) ABSTRACT

Various embodiments provide methods and apparatus for forming bulk metallic glass (BMG) articles using a mold having a stationary mold part and a movable mold part paired to form a mold cavity. A molten material can be injected to fill the mold cavity. The molten material can then be cooled into a BMG article at a desired cooling rate. While injecting and/or cooling the molten material, the movement of the movable mold part can be controlled, such that a thermal contact between the molten material and the mold can be maintained. BMG articles can be formed without forming an underfilled part. Additional structural features can be imparted in the BMG article during formation. At least a portion of the formed BMG article can have an aspect ratio (first dimension/second dimension) of at least 10 or less than 0.1.

23 Claims, 4 Drawing Sheets

(56) References Cited

U.S. PATENT DOCUMENTS

| | | | | |
|---|---|---|---|---|
| 4,254,933 | A | 3/1981 | Netto | |
| 4,442,061 | A * | 4/1984 | Matsuda et al. | 264/328.7 |
| 5,288,344 | A | 2/1994 | Peker | |
| 5,368,659 | A | 11/1994 | Peker | |
| 5,618,359 | A | 4/1997 | Lin | |
| 5,711,363 | A | 1/1998 | Scruggs et al. | |
| 5,735,975 | A | 4/1998 | Lin | |
| 5,896,642 | A | 4/1999 | Peker | |
| 5,906,235 | A * | 5/1999 | Thomas et al. | 164/120 |
| 6,021,840 | A | 2/2000 | Colvin | |
| 6,189,600 | B1 | 2/2001 | Taniguchi et al. | |
| 6,267,170 | B1 | 7/2001 | Onuki | |
| 6,267,171 | B1 | 7/2001 | Onuki | |
| 6,283,197 | B1 | 9/2001 | Kono | |
| 6,325,868 | B1 | 12/2001 | Kim | |
| 6,371,195 | B1 | 4/2002 | Onuki | |
| 6,427,753 | B1 | 8/2002 | Inoue | |
| 6,805,758 | B2 * | 10/2004 | Wolter | 148/403 |
| 6,875,293 | B2 | 4/2005 | Peker | |
| 7,017,645 | B2 | 3/2006 | Johnson et al. | |
| 7,377,303 | B2 | 5/2008 | Go | |
| 7,488,170 | B2 | 2/2009 | Yuasa et al. | |
| 7,575,040 | B2 | 8/2009 | Johnson | |
| 7,708,844 | B2 | 5/2010 | Muramatsu | |
| 7,906,219 | B2 | 3/2011 | Ohara | |
| 2002/0005233 | A1 | 1/2002 | Schirra et al. | |
| 2005/0028961 | A1 | 2/2005 | Toyoshima et al. | |
| 2005/0242454 | A1 | 11/2005 | Yuasa et al. | |
| 2006/0254747 | A1 | 11/2006 | Ishida et al. | |
| 2007/0079907 | A1 | 4/2007 | Johnson et al. | |
| 2008/0135136 | A1 | 6/2008 | Demetriou et al. | |
| 2008/0305387 | A1 | 12/2008 | Murray et al. | |
| 2009/0162629 | A1 | 6/2009 | Demetriou et al. | |
| 2009/0236494 | A1 | 9/2009 | Hata et al. | |
| 2009/0321037 | A1 | 12/2009 | Lewis | |
| 2010/0084052 | A1 | 4/2010 | Farmer | |
| 2010/0230012 | A1 | 9/2010 | Demetriou et al. | |
| 2010/0300148 | A1 | 12/2010 | Demetriou et al. | |
| 2011/0079940 | A1 | 4/2011 | Schroers | |
| 2011/0108231 | A1 | 5/2011 | Zheng et al. | |

FOREIGN PATENT DOCUMENTS

| | | |
|---|---|---|
| EP | 1365038 | 11/2003 |
| EP | 1415740 | 5/2004 |
| EP | 1696153 | 8/2006 |
| EP | 1759781 | 3/2007 |
| FR | 2665654 | 2/1992 |
| JP | 6212205 | 8/1994 |
| JP | 9272929 | 10/1997 |
| JP | 2000024767 | 1/2000 |
| JP | 2000117411 | 4/2000 |
| JP | 2000326065 | 11/2000 |
| JP | 2001303218 | 10/2001 |
| JP | 2004050269 | 2/2004 |
| JP | 2006289466 | 10/2006 |
| JP | 2010036210 | 2/2010 |
| WO | WO0037201 | 6/2000 |
| WO | WO2008046219 | 4/2008 |
| WO | WO2009067512 | 5/2009 |

OTHER PUBLICATIONS

Inoue et al., "Bulk amorphous alloys with high mechanical strength and good soft magnetic properties in Fe-Tm-B(TM=IV-VIII group transition metal) system", Appl. Phys. Lett., vol. 710, p. 464 (1997).
Shen et al., 01., "Bulk Glassy CO43FE20TA5.5B31.5 Alloy with High Glass-Forming Ability and Good Soft Magnetic Properties", Materials Transactions, vol. 42 No. 10 (2001) pp. 2136-2139.
McDeavitt et al., "High Temperature Interaction Behavior at Liquid Metal-Ceramic Interfaces", Journal of Materials Engineering and Performance, vol. 11, Aug. 2002.
Kargahi et al., "Analysis of failure of conducting crucible used in induction metal", Aug. 1988.
Inoue et al., "Microstructure and Properties of Bulky Al84Ni10Ce6 Alloys with Amorphous Surface Layer Prepared by High-Pressure Die Casting", Materials Transactions, JIM, vol. 35, No. 11 (1994), pp. 808-813.
International Search Report issued in PCT/US2011/054153, mailed Jun. 13, 2012.
International Search Report and Written Opinion, PCT/ISA/210, PCT/ISA1220, PCT/ISA/237, mail date Mar. 21, 2014.
J. Schroers, "Processing of Bulk Metallic Glass", Adv. Mater., vol. 22, 2010, pp. 1566-1597.
Mingwei Chen, "A brief overview of bulk metallic glasses", NPG Asia Materials, vol. 3, Sep. 2011, pp. 82-90.

* cited by examiner

PRIOR ART

PRIOR ART

INJECTION COMPRESSION MOLDING OF AMORPHOUS ALLOYS

FIELD

This disclosure relates generally to bulk metallic glasses ("BMG") articles formed of bulk solidifying amorphous alloys, and in particular, to improving processability of forming BMG articles.

BACKGROUND

A large portion of the metallic alloys in use today are processed by solidification casting, at least initially. The metallic alloy is melted and cast into a metal or ceramic mold, where it solidifies. The mold is stripped away, and the cast metallic piece is ready for use or further processing. The as-cast structure of most materials produced during solidification and cooling depends upon the cooling rate. There is no general rule for the nature of the variation, but for the most part the structure changes only gradually with changes in cooling rate. On the other hand, for the bulk-solidifying amorphous alloys the change between the amorphous state produced by relatively rapid cooling and the crystalline state produced by relatively slower cooling is one of kind rather than degree—the two states have distinct properties.

Bulk-solidifying amorphous alloys, or bulk metallic glasses ("BMG"), are a recently developed class of metallic materials. This amorphous state can be highly advantageous for certain applications. If the cooling rate is not sufficiently high, crystals may form inside the alloy during cooling, so that the benefits of the amorphous state are partially or completely lost. For example, one risk with the creation of bulk amorphous alloy parts is partial crystallization due to either slow cooling or impurities in the raw material.

Bulk-solidifying amorphous alloys have been made in a variety of metallic systems. They are generally prepared by quenching from above the melting temperature to the ambient temperature. Generally, high cooling rates, such as one on the order of 105° C./sec, are needed to achieve an amorphous structure. The lowest rate by which a bulk solidifying alloy can be cooled to avoid crystallization, thereby achieving and maintaining the amorphous structure during cooling, is referred to as the "critical cooling rate" for the alloy. In order to achieve a cooling rate higher than the critical cooling rate, heat has to be extracted from the sample.

BMG articles are often formed by injection molding and/or die casting of a molten material cooled by thermal contact with a mold or a die. Problems arise, however, due to shrinking of the cooled material. The shrinkage generates a gap between the molten material and wall of the mold, reduces thermal contact there-between, and thus reduces the cooling rate of the molten material. The reduced cooling rate increases the potential for forming crystalline. In addition, the formed article may have undesired surface finishes and/or an underfilled part due to the gap formed between the molten material and the wall of the mold. Further, it is difficult to form BMG articles with high aspect ratio or small sections. This is because the molten material will cool off so rapidly that it will solidify before it can fill the entire mold cavity.

SUMMARY

Various embodiments relate to improving the processability of forming BMG articles by incorporating injection compression molding, such that, for example, (1) a heat transfer can be provided between the molten material and interior surfaces of the mold to maintain a desired cooling rate to form the article in an amorphous state; (2) the mold cavity can be substantially entirely filled with the molten material without forming a gap there-between; and/or (3) the formed BMG article is capable of having an aspect ratio of at least about 10 or less than about 0.1 to form small sections, or thin structures, e.g., thin inflections. In addition, the BMG article can be formed with desired surface finishes and structural features.

In accordance with various embodiments, there is provided a method of forming a BMG article using a mold. The mold may include a stationary mold part and a movable mold part paired to form a mold cavity. Once the mold cavity is formed, a molten material can be injected to fill the mold cavity. The molten material in the mold cavity can then be cooled into a bulk metallic glass (BMG) article at a desired cooling rate. While injecting and/or cooling the molten material, the movement of the movable mold part can be controlled to maintain a thermal contact between the molten material and the mold and thus to maintain the cooling rate.

In accordance with various embodiments, there is provided a method of forming a BMG article using a mold. The mold may include a stationary mold part and a movable mold part paired to form a mold cavity. Once the mold cavity is formed, a molten material can be injected to fill the mold cavity. The molten material in the mold cavity can then be cooled into a bulk metallic glass (BMG) article at a desired cooling rate. While injecting and/or cooling the molten material, the movement of the movable mold part can be controlled such that at least a portion of the formed BMG article has an aspect ratio of at least 10 or less than 0.1.

In accordance with various embodiments, there is provided a method of forming a BMG article using a mold. The mold may include a stationary mold part and a movable mold part paired to form a mold cavity. Once the mold cavity is formed, a molten material can be injected to fill the mold cavity. The molten material in the mold cavity can then be cooled into a bulk metallic glass (BMG) article at a desired cooling rate. While injecting and/or cooling the molten material, the movement of the movable mold part can be controlled to add additional structural features in the BMG article.

In accordance with various embodiments, there is provided an injection compression molding apparatus. The apparatus may include a mold, an injection unit, and/or a mechanical unit. The mold may include a stationary mold part and a movable mold part paired to form a mold cavity. The injection unit can be configured to inject a molten material into the mold cavity such that the molten material can be cooled into a BMG article at a desired cooling rate in the mold cavity. The mechanical unit can be configured to control movement of the movable mold part while the molten material is injected and cooled in the mold cavity.

DETAILED DESCRIPTION

All publications, patents, and patent applications cited in this Specification are hereby incorporated by reference in their entirety.

The articles "a" and "an" are used herein to refer to one or to more than one (i.e., to at least one) of the grammatical object of the article. By way of example, "a polymer resin" means one polymer resin or more than one polymer resin. Any ranges cited herein are inclusive. The terms "substantially" and "about" used throughout this Specification are used to describe and account for small fluctuations. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%.

Bulk-solidifying amorphous alloys, or bulk metallic glasses ("BMG"), are a recently developed class of metallic materials. These alloys may be solidified and cooled at relatively slow rates, and they retain the amorphous, non-crystalline (i.e., glassy) state at room temperature. Amorphous alloys have many superior properties than their crystalline counterparts. However, if the cooling rate is not sufficiently high, crystals may form inside the alloy during cooling, so that the benefits of the amorphous state can be lost. For example, one challenge with the fabrication of bulk amorphous alloy parts is partial crystallization of the parts due to either slow cooling or impurities in the raw alloy material. As a high degree of amorphicity (and, conversely, a low degree of crystallinity) is desirable in BMG articles, there is a need to develop methods for casting BMG articles having controlled amount of amorphicity.

Figure 1:
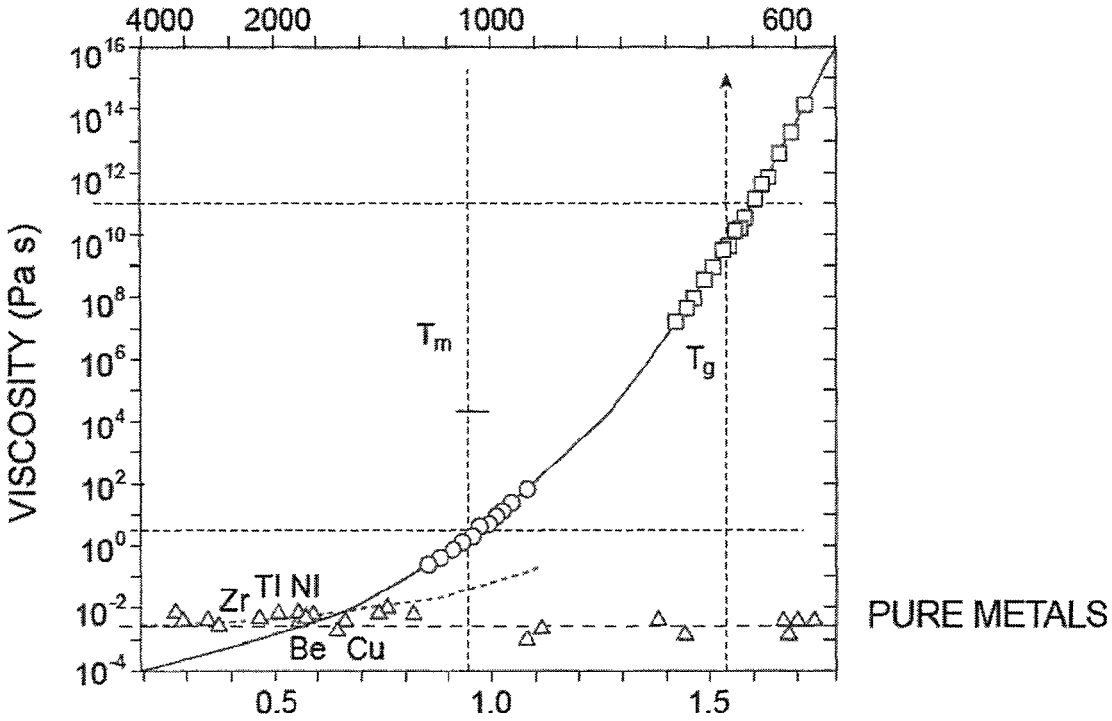
FIG. 1 provides a temperature-viscosity diagram of an exemplary bulk solidifying amorphous alloy.

FIG. 1 (obtained from U.S. Pat. No. 7,575,040) shows a viscosity-temperature graph of an exemplary bulk solidifying amorphous alloy, from the VIT-001 series of Zr—Ti—Ni—Cu—Be family manufactured by Liquidmetal Technology. It should be noted that there is no clear liquid/solid transformation for a bulk solidifying amorphous metal during the formation of an amorphous solid. The molten alloy becomes more and more viscous with increasing undercooling until it approaches solid form around the glass transition temperature. Accordingly, the temperature of solidification front for bulk solidifying amorphous alloys can be around glass transition temperature, where the alloy will practically act as a solid for the purposes of pulling out the quenched amorphous sheet product.

Figure 2:
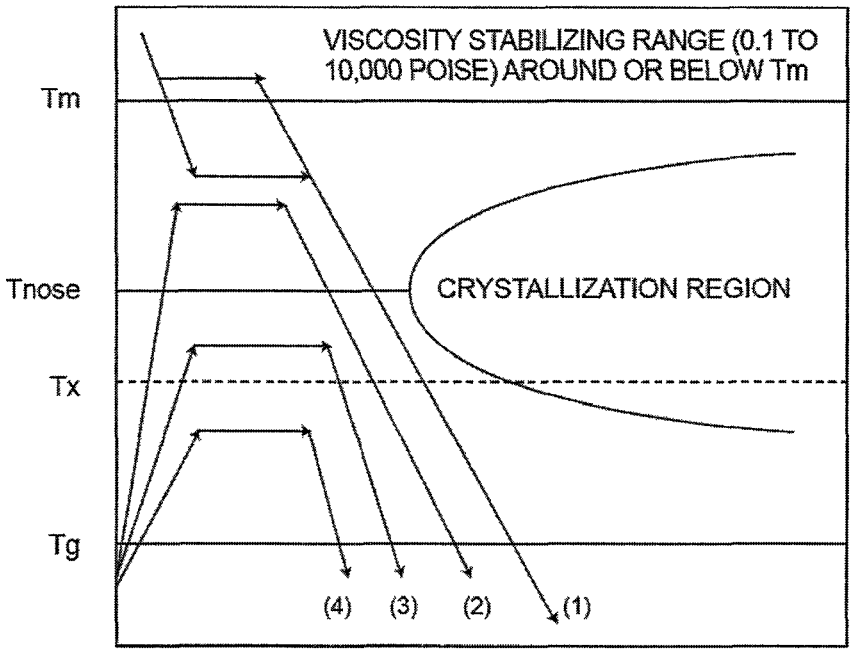
FIG. 2 provides a schematic of a time-temperature-transformation (TTT) diagram for an exemplary bulk solidifying amorphous alloy.

FIG. 2 (obtained from U.S. Pat. No. 7,575,040) shows the time-temperature-transformation (TTT) cooling curve of an exemplary bulk solidifying amorphous alloy, or TTT diagram. Bulk-solidifying amorphous metals do not experience a liquid/solid crystallization transformation upon cooling, as with conventional metals. Instead, the highly fluid, non crystalline form of the metal found at high temperatures (near a "melting temperature" Tm) becomes more viscous as the temperature is reduced (near to the glass transition temperature Tg), eventually taking on the outward physical properties of a conventional solid.

Even though there is no liquid/crystallization transformation for a bulk solidifying amorphous metal, a "melting temperature" Tm may be defined as the thermodynamic liquidus temperature of the corresponding crystalline phase. Under this regime, the viscosity of bulk-solidifying amorphous alloys at the melting temperature could lie in the range of about 0.1 poise to about 10,000 poise, and even sometimes under 0.01 poise. A lower viscosity at the "melting temperature" would provide faster and complete filling of intricate portions of the shell/mold with a bulk solidifying amorphous metal for forming the BMG articles. Furthermore, the cooling rate of the molten metal to form a BMG article has to such that the time-temperature profile during cooling does not traverse through the nose-shaped region bounding the crystallized region in the TTT diagram of FIG. 2. In FIG. 2, Tnose is the critical crystallization temperature Tx where crystallization is most rapid and occurs in the shortest time scale.

The supercooled liquid region, the temperature region between Tg and Tx is a manifestation of the extraordinary stability against crystallization of bulk solidification alloys. In this temperature region the bulk solidifying alloy can exist as a high viscous liquid. The viscosity of the bulk solidifying alloy in the supercooled liquid region can vary between $10^{12}$ Pa s at the glass transition temperature down to $10^5$ Pa s at the crystallization temperature, the high temperature limit of the supercooled liquid region. Liquids with such viscosities can undergo substantial plastic strain under an applied pressure. The embodiments herein make use of the large plastic formability in the supercooled liquid region as a forming and separating method.

One needs to clarify something about Tx. Technically, the nose-shaped curve shown in the TTT diagram describes Tx as a function of temperature and time. Thus, regardless of the trajectory that one takes while heating or cooling a metal alloy, when one hits the TTT curve, one has reached Tx. In FIG. 2, Tx is shown as a dashed line as Tx can vary from close to Tm to close to Tg.

The schematic TTT diagram of FIG. 2 shows processing methods of die casting from at or above Tm to below Tg without the time-temperature trajectory (shown as (1) as an example trajectory) hitting the TTT curve. During die casting, the forming takes place substantially simultaneously with fast cooling to avoid the trajectory hitting the TTT curve. The processing methods for superplastic forming (SPF) from at or below Tg to below Tm without the time-temperature trajectory (shown as (2), (3) and (4) as example trajectories) hitting the TTT curve. In SPF, the amorphous BMG is reheated into the supercooled liquid region where the available processing window could be much larger than die casting, resulting in better controllability of the process. The SPF process does not require fast cooling to avoid crystallization during cooling. Also, as shown by example trajectories (2), (3) and (4), the SPF can be carried out with the highest temperature during SPF being above Tnose or below Tnose, up to about Tm. If one heats up a piece of amorphous alloy but manages to avoid hitting the TTT curve, you have heated "between Tg and Tm", but one would have not reached Tx.

Typical differential scanning calorimeter (DSC) heating curves of bulk-solidifying amorphous alloys taken at a heating rate of 20 C/min describe, for the most part, a particular trajectory across the TTT data where one would likely see a Tg at a certain temperature, a Tx when the DSC heating ramp crosses the TTT crystallization onset, and eventually melting peaks when the same trajectory crosses the temperature range for melting. If one heats a bulk-solidifying amorphous alloy at a rapid heating rate as shown by the ramp up portion of trajectories (2), (3) and (4) in FIG. 2, then one could avoid the TTT curve entirely, and the DSC data would show a glass transition but no Tx upon heating. Another way to think about it is trajectories (2), (3) and (4) can fall anywhere in temperature between the nose of the TTT curve (and even above it) and the Tg line, as long as it does not hit the crystallization curve. That just means that the horizontal plateau in trajectories might get much shorter as one increases the processing temperature.

Phase

The term "phase" herein can refer to one that can be found in a thermodynamic phase diagram. A phase is a region of space (e.g., a thermodynamic system) throughout which all physical properties of a material are essentially uniform. Examples of physical properties include density, index of refraction, chemical composition and lattice periodicity. A simple description of a phase is a region of material that is chemically uniform, physically distinct, and/or mechanically separable. For example, in a system consisting of ice and water in a glass jar, the ice cubes are one phase, the water is a second phase, and the humid air over the water is a third phase. The glass of the jar is another separate phase. A phase can refer to a solid solution, which can be a binary, tertiary, quaternary, or more, solution, or a compound, such as an intermetallic compound. As another example, an amorphous phase is distinct from a crystalline phase.

Metal, Transition Metal, and Non-Metal

The term "metal" refers to an electropositive chemical element. The term "element" in this Specification refers generally to an element that can be found in a Periodic Table. Physically, a metal atom in the ground state contains a partially filled band with an empty state close to an occupied state. The term "transition metal" is any of the metallic elements within Groups 3 to 12 in the Periodic Table that have an incomplete inner electron shell and that serve as transitional links between the most and the least electropositive in a series of elements. Transition metals are characterized by multiple valences, colored compounds, and the ability to form stable complex ions. The term "nonmetal" refers to a chemical element that does not have the capacity to lose electrons and form a positive ion.

Depending on the application, any suitable nonmetal elements, or their combinations, can be used. The alloy (or "alloy composition") can include multiple nonmetal elements, such as at least two, at least three, at least four, or more, nonmetal elements. A nonmetal element can be any element that is found in Groups 13-17 in the Periodic Table. For example, a nonmetal element can be any one of F, Cl, Br, I, At, O, S, Se, Te, Po, N, P, As, Sb, Bi, C, Si, Ge, Sn, Pb, and B. Occasionally, a nonmetal element can also refer to certain metalloids (e.g., B, Si, Ge, As, Sb, Te, and Po) in Groups 13-17. In one embodiment, the nonmetal elements can include B, Si, C, P, or combinations thereof. Accordingly, for example, the alloy can include a boride, a carbide, or both.

A transition metal element can be any of scandium, titanium, vanadium, chromium, manganese, iron, cobalt, nickel, copper, zinc, yttrium, zirconium, niobium, molybdenum, technetium, ruthenium, rhodium, palladium, silver, cadmium, hafnium, tantalum, tungsten, rhenium, osmium, iridium, platinum, gold, mercury, rutherfordium, dubnium, seaborgium, bohrium, hassium, meitnerium, ununnilium, unununium, and ununbium. In one embodiment, a BMG containing a transition metal element can have at least one of Sc, Y, La, Ac, Ti, Zr, Hf, V, Nb, Ta, Cr, Mo, W, Mn, Tc, Re, Fe, Ru, Os, Co, Rh, Ir, Ni, Pd, Pt, Cu, Ag, Au, Zn, Cd, and Hg. Depending on the application, any suitable transitional metal elements, or their combinations, can be used. The alloy composition can include multiple transitional metal elements, such as at least two, at least three, at least four, or more, transitional metal elements.

The presently described alloy or alloy "sample" or "specimen" alloy can have any shape or size. For example, the alloy can have a shape of a particulate, which can have a shape such as spherical, ellipsoid, wire-like, rod-like, sheet-like, flake-like, or an irregular shape. The particulate can have any size. For example, it can have an average diameter of between about 1 micron and about 100 microns, such as between about 5 microns and about 80 microns, such as between about 10 microns and about 60 microns, such as between about 15 microns and about 50 microns, such as between about 15 microns and about 45 microns, such as between about 20 microns and about 40 microns, such as between about 25 microns and about 35 microns. For example, in one embodiment, the average diameter of the particulate is between about 25 microns and about 44 microns. In some embodiments, smaller particulates, such as those in the nanometer range, or larger particulates, such as those bigger than 100 microns, can be used.

The alloy sample or specimen can also be of a much larger dimension. For example, it can be a bulk structural component, such as an ingot, housing/casing of an electronic device or even a portion of a structural component that has dimensions in the millimeter, centimeter, or meter range.

Solid Solution

The term "solid solution" refers to a solid form of a solution. The term "solution" refers to a mixture of two or more substances, which may be solids, liquids, gases, or a combination of these. The mixture can be homogeneous or heterogeneous. The term "mixture" is a composition of two or more substances that are combined with each other and are generally capable of being separated. Generally, the two or more substances are not chemically combined with each other.

Alloy

In some embodiments, the alloy composition described herein can be fully alloyed. In one embodiment, an "alloy" refers to a homogeneous mixture or solid solution of two or more metals, the atoms of one replacing or occupying interstitial positions between the atoms of the other; for example, brass is an alloy of zinc and copper. An alloy, in contrast to a composite, can refer to a partial or complete solid solution of one or more elements in a metal matrix, such as one or more compounds in a metallic matrix. The term alloy herein can refer to both a complete solid solution alloy that can give single solid phase microstructure and a partial solution that can give two or more phases. An alloy composition described herein can refer to one comprising an alloy or one comprising an alloy-containing composite.

Thus, a fully alloyed alloy can have a homogenous distribution of the constituents, be it a solid solution phase, a compound phase, or both. The term "fully alloyed" used herein can account for minor variations within the error tolerance. For example, it can refer to at least 90% alloyed, such as at least 95% alloyed, such as at least 99% alloyed, such as at least 99.5% alloyed, such as at least 99.9% alloyed. The percentage herein can refer to either volume percent or weight percentage, depending on the context. These percentages can be balanced by impurities, which can be in terms of composition or phases that are not a part of the alloy.

Amorphous or Non-Crystalline Solid

An "amorphous" or "non-crystalline solid" is a solid that lacks lattice periodicity, which is characteristic of a crystal. As used herein, an "amorphous solid" includes "glass" which is an amorphous solid that softens and transforms into a liquid-like state upon heating through the glass transition. Generally, amorphous materials lack the long-range order characteristic of a crystal, though they can possess some short-range order at the atomic length scale due to the nature of chemical bonding. The distinction between amorphous solids and crystalline solids can be made based on lattice periodicity as determined by structural characterization techniques such as x-ray diffraction and transmission electron microscopy.

The terms "order" and "disorder" designate the presence or absence of some symmetry or correlation in a many-particle system. The terms "long-range order" and "short-range order" distinguish order in materials based on length scales.

The strictest form of order in a solid is lattice periodicity: a certain pattern (the arrangement of atoms in a unit cell) is repeated again and again to form a translationally invariant tiling of space. This is the defining property of a crystal. Possible symmetries have been classified in 14 Bravais lattices and 230 space groups.

Lattice periodicity implies long-range order. If only one unit cell is known, then by virtue of the translational symmetry it is possible to accurately predict all atomic positions at arbitrary distances. The converse is generally true, except, for example, in quasi-crystals that have perfectly deterministic tilings but do not possess lattice periodicity.

Long-range order characterizes physical systems in which remote portions of the same sample exhibit correlated behavior. This can be expressed as a correlation function, namely the spin-spin correlation function:

$$G(x,x')=\langle s(x),s(x')\rangle.$$

In the above function, s is the spin quantum number and x is the distance function within the particular system. This function is equal to unity when x=x' and decreases as the distance |x−x'| increases. Typically, it decays exponentially to zero at large distances, and the system is considered to be disordered. If, however, the correlation function decays to a constant value at large |x−x'|, then the system can be said to possess long-range order. If it decays to zero as a power of the distance, then it can be called quasi-long-range order. Note that what constitutes a large value of |x−x'| is relative.

A system can be said to present quenched disorder when some parameters defining its behavior are random variables that do not evolve with time (i.e., they are quenched or frozen)—e.g., spin glasses. It is opposite to annealed disorder, where the random variables are allowed to evolve themselves. Embodiments herein include systems comprising quenched disorder.

The alloy described herein can be crystalline, partially crystalline, amorphous, or substantially amorphous. For example, the alloy sample/specimen can include at least some crystallinity, with grains/crystals having sizes in the nanometer and/or micrometer ranges. Alternatively, the alloy can be substantially amorphous, such as fully amorphous. In one embodiment, the alloy composition is at least substantially not amorphous, such as being substantially crystalline, such as being entirely crystalline.

In one embodiment, the presence of a crystal or a plurality of crystals in an otherwise amorphous alloy can be construed as a "crystalline phase" therein. The degree of crystallinity (or "crystallinity" for short in some embodiments) of an alloy can refer to the amount of the crystalline phase present in the alloy. The degree can refer to, for example, a fraction of crystals present in the alloy. The fraction can refer to volume fraction or weight fraction, depending on the context. A measure of how "amorphous" an amorphous alloy is can be amorphicity. Amorphicity can be measured in terms of a degree of crystallinity. For example, in one embodiment, an alloy having a low degree of crystallinity can be said to have a high degree of amorphicity. In one embodiment, for example, an alloy having 60 vol % crystalline phase can have a 40 vol % amorphous phase.

Amorphous Alloy or Amorphous Metal

An "amorphous alloy" is an alloy having an amorphous content of more than 50% by volume, preferably more than 90% by volume of amorphous content, more preferably more than 95% by volume of amorphous content, and most preferably more than 99% to almost 100% by volume of amorphous content. Note that, as described above, an alloy high in amorphicity is equivalently low in degree of crystallinity. An "amorphous metal" is an amorphous metal material with a disordered atomic-scale structure. In contrast to most metals, which are crystalline and therefore have a highly ordered arrangement of atoms, amorphous alloys are non-crystalline. Materials in which such a disordered structure is produced directly from the liquid state during cooling are sometimes referred to as "glasses." Accordingly, amorphous metals are commonly referred to as "metallic glasses" or "glassy metals." In one embodiment, a bulk metallic glass ("BMG") can refer to an alloy, of which the microstructure is at least partially amorphous. However, there are several ways besides extremely rapid cooling to produce amorphous metals, including physical vapor deposition, solid-state reaction, ion irradiation, melt spinning, and mechanical alloying. Amorphous alloys can be a single class of materials, regardless of how they are prepared.

Amorphous metals can be produced through a variety of quick-cooling methods. For instance, amorphous metals can be produced by sputtering molten metal onto a spinning metal disk. The rapid cooling, on the order of millions of degrees a second, can be too fast for crystals to form, and the material is thus "locked in" a glassy state. Also, amorphous metals/alloys can be produced with critical cooling rates low enough to allow formation of amorphous structures in thick layers—e.g., bulk metallic glasses.

The terms "bulk metallic glass" ("BMG"), bulk amorphous alloy ("BAA"), and bulk solidifying amorphous alloy are used interchangeably herein. They refer to amorphous alloys having the smallest dimension at least in the millimeter range. For example, the dimension can be at least about 0.5 mm, such as at least about 1 mm, such as at least about 2 mm, such as at least about 4 mm, such as at least about 5 mm, such as at least about 6 mm, such as at least about 8 mm, such as at least about 10 mm, such as at least about 12 mm. Depending on the geometry, the dimension can refer to the diameter, radius, thickness, width, length, etc. A BMG can also be a metallic glass having at least one dimension in the centimeter range, such as at least about 1.0 cm, such as at least about 2.0 cm, such as at least about 5.0 cm, such as at least about 10.0 cm. In some embodiments, a BMG can have at least one dimension at least in the meter range. A BMG can take any of the shapes or forms described above, as related to a metallic glass. Accordingly, a BMG described herein in some embodiments can be different from a thin film made by a conventional deposition technique in one important aspect—the former can be of a much larger dimension than the latter.

Amorphous metals can be an alloy rather than a pure metal. The alloys may contain atoms of significantly different sizes, leading to low free volume (and therefore having viscosity up to orders of magnitude higher than other metals and alloys) in a molten state. The viscosity prevents the atoms from moving enough to form an ordered lattice. The material structure may result in low shrinkage during cooling and resistance to plastic deformation. The absence of grain boundaries, the weak spots of crystalline materials in some cases, may, for example, lead to better resistance to wear and corrosion. In one embodiment, amorphous metals, while technically glasses, may also be much tougher and less brittle than oxide glasses and ceramics.

Thermal conductivity of amorphous materials may be lower than that of their crystalline counterparts. To achieve formation of an amorphous structure even during slower cooling, the alloy may be made of three or more components, leading to complex crystal units with higher potential energy and lower probability of formation. The formation of amorphous alloy can depend on several factors: the composition of the components of the alloy; the atomic radius of the components (preferably with a significant difference of over 12% to achieve high packing density and low free volume); and the negative heat of mixing the combination of components, inhibiting crystal nucleation and prolonging the time the molten metal stays in a supercooled state. However, as the formation of an amorphous alloy is based on many different variables, it can be difficult to make a prior determination of whether an alloy composition would form an amorphous alloy.

Amorphous alloys, for example, of boron, silicon, phosphorus, and other glass formers with magnetic metals (iron, cobalt, nickel) may be magnetic, with low coercivity and high electrical resistance. The high resistance leads to low losses by eddy currents when subjected to alternating magnetic fields, a property useful, for example, as transformer magnetic cores.

Amorphous alloys may have a variety of potentially useful properties. In particular, they tend to be stronger than crystalline alloys of similar chemical composition, and they can sustain larger reversible ("elastic") deformations than crystalline alloys. Amorphous metals derive their strength directly from their non-crystalline structure, which can have none of the defects (such as dislocations) that limit the strength of crystalline alloys. For example, one modern amorphous metal, known as Vitreloy™, has a tensile strength that is almost twice that of high-grade titanium. In some embodiments, metallic glasses at room temperature are not ductile and tend to fail suddenly when loaded in tension, which limits the material applicability in reliability-critical applications, as the impending failure is not evident. Therefore, to overcome this challenge, metal matrix composite materials having a metallic glass matrix containing dendritic particles or fibers of a ductile crystalline metal can be used. Alternatively, a BMG low in element(s) that tend to cause embitterment (e.g., Ni) can be used. For example, a Ni-free BMG can be used to improve the ductility of the BMG.

Another useful property of bulk amorphous alloys is that they can be true glasses; in other words, they can soften and flow upon heating. This can allow for easy processing, such as by injection molding, in much the same way as polymers. As a result, amorphous alloys can be used for making sports equipment, medical devices, electronic components and equipment, and thin films. Thin films of amorphous metals can be deposited as protective coatings via a high velocity oxygen fuel technique.

A material can have an amorphous phase, a crystalline phase, or both. The amorphous and crystalline phases can have the same chemical composition and differ only in the microstructure—i.e., one amorphous and the other crystalline. Microstructure in one embodiment refers to the structure of a material as revealed by a microscope at 25× magnification or higher. Alternatively, the two phases can have different chemical compositions and microstructures. For example, a composition can be partially amorphous, substantially amorphous, or completely amorphous.

As described above, the degree of amorphicity (and conversely the degree of crystallinity) can be measured by fraction of crystals present in the alloy. The degree can refer to volume fraction of weight fraction of the crystalline phase present in the alloy. A partially amorphous composition can refer to a composition of at least about 5 vol % of which is of an amorphous phase, such as at least about 10 vol %, such as at least about 20 vol %, such as at least about 40 vol %, such as at least about 60 vol %, such as at least about 80 vol %, such as at least about 90 vol %. The terms "substantially" and "about" have been defined elsewhere in this application. Accordingly, a composition that is at least substantially amorphous can refer to one of which at least about 90 vol % is amorphous, such as at least about 95 vol %, such as at least about 98 vol %, such as at least about 99 vol %, such as at least about 99.5 vol %, such as at least about 99.8 vol %, such as at least about 99.9 vol %. In one embodiment, a substantially amorphous composition can have some incidental, insignificant amount of crystalline phase present therein.

In one embodiment, an amorphous alloy composition can be homogeneous with respect to the amorphous phase. A substance that is uniform in composition is homogeneous. This is in contrast to a substance that is heterogeneous. The term "composition" refers to the chemical composition and/or microstructure in the substance. A substance is homogeneous when a volume of the substance is divided in half and both halves have substantially the same composition. For example, a particulate suspension is homogeneous when a volume of the particulate suspension is divided in half and both halves have substantially the same volume of particles. However, it might be possible to see the individual particles under a microscope. Another example of a homogeneous substance is air where different ingredients therein are equally suspended, though the particles, gases and liquids in air can be analyzed separately or separated from air.

A composition that is homogeneous with respect to an amorphous alloy can refer to one having an amorphous phase substantially uniformly distributed throughout its microstructure. In other words, the composition macroscopically includes a substantially uniformly distributed amorphous alloy throughout the composition. In an alternative embodiment, the composition can be of a composite, having an amorphous phase having therein a non-amorphous phase. The non-amorphous phase can be a crystal or a plurality of crystals. The crystals can be in the form of particulates of any shape, such as spherical, ellipsoid, wire-like, rod-like, sheet-like, flake-like, or an irregular shape. In one embodiment, it can have a dendritic form. For example, an at least partially amorphous composite composition can have a crystalline phase in the shape of dendrites dispersed in an amorphous phase matrix; the dispersion can be uniform or non-uniform, and the amorphous phase and the crystalline phase can have the same or a different chemical composition. In one embodiment, they have substantially the same chemical composition. In another embodiment, the crystalline phase can be more ductile than the BMG phase.

The methods described herein can be applicable to any type of amorphous alloy. Similarly, the amorphous alloy described herein as a constituent of a composition or article can be of any type. The amorphous alloy can include the element Zr, Hf, Ti, Cu, Ni, Pt, Pd, Fe, Mg, Au, La, Ag, Al, Mo, Nb, Be, or combinations thereof. Namely, the alloy can include any combination of these elements in its chemical formula or chemical composition. The elements can be present at different weight or volume percentages. For example, an iron "based" alloy can refer to an alloy having a non-insignificant weight percentage of iron present therein, the weight percent can be, for example, at least about 20 wt %, such as at least about 40 wt %, such as at least about 50 wt %, such as at least about 60 wt %, such as at least about 80 wt %. Alternatively, in one embodiment, the above-described percentages can be volume percentages, instead of weight percentages. Accordingly, an amorphous alloy can be zirconium-based, titanium-based, platinum-based, palladium-based, gold-based, silver-based, copper-based, iron-based, nickel-based, aluminum-based, molybdenum-based, and the like. The alloy can also be free of any of the aforementioned elements to suit a particular purpose. For example, in some embodiments, the alloy, or the composition including the alloy, can be substantially free of nickel, aluminum, titanium, beryllium, or combinations thereof. In one embodiment, the alloy or the composite is completely free of nickel, aluminum, titanium, beryllium, or combinations thereof.

For example, the amorphous alloy can have the formula $(Zr, Ti)_a(Ni, Cu, Fe)_b(Be, Al, Si, B)_c$, wherein a, b, and c each represents a weight or atomic percentage. In one embodiment, a is in the range of from 30 to 75, b is in the range of from 5 to 60, and c is in the range of from 0 to 50 in atomic percentages. Alternatively, the amorphous alloy can have the formula $(Zr, Ti)_a(Ni, Cu)_b(Be)_c$, wherein a, b, and c each represents a weight or atomic percentage. In one embodiment, a is in the range of from 40 to 75, b is in the range of from 5 to 50, and c is in the range of from 5 to 50 in atomic percentages. The alloy can also have the formula $(Zr, Ti)_a(Ni, Cu)_b(Be)_c$, wherein a, b, and c each represents a weight or atomic percentage. In one embodiment, a is in the range of from 45 to 65, b is in the range of from 7.5 to 35, and c is in the range of from 10 to 37.5 in atomic percentages. Alternatively, the alloy can have the formula $(Zr)_a(Nb, Ti)_b(Ni, Cu)_c(Al)_d$, wherein a, b, c, and d each represents a weight or atomic percentage. In one embodiment, a is in the range of from 45 to 65, b is in the range of from 0 to 10, c is in the range of from 20 to 40 and d is in the range of from 7.5 to 15 in atomic percentages. One exemplary embodiment of the afore-described alloy system is a Zr—Ti—Ni—Cu—Be based amorphous alloy under the trade name Vitreloy™, such as Vitreloy-1 and Vitreloy-101, as fabricated by Liquidmetal Technologies, CA, USA. Some examples of amorphous alloys of the different systems are provided in Table 1 and Table 2.

TABLE 1

Exemplary amorphous alloy compositions

| Alloy | Atm % | Atm % | Atm % | Atm % | Atm % | Atm % | Atm % | Atm % |
|---|---|---|---|---|---|---|---|---|
| 1 | Fe | Mo | Ni | Cr | P | C | B | |
| | 68.00% | 5.00% | 5.00% | 2.00% | 12.50% | 5.00% | 2.50% | |
| 2 | Fe | Mo | Ni | Cr | P | C | B | Si |
| | 68.00% | 5.00% | 5.00% | 2.00% | 11.00% | 5.00% | 2.50% | 1.50% |
| 3 | Pd | Cu | Co | P | | | | |
| | 44.48% | 32.35% | 4.05% | 19.11% | | | | |
| 4 | Pd | Ag | Si | P | | | | |
| | 77.50% | 6.00% | 9.00% | 7.50% | | | | |
| 5 | Pd | Ag | Si | P | Ge | | | |
| | 79.00% | 3.50% | 9.50% | 6.00% | 2.00% | | | |
| 6 | Pt | Cu | Ag | P | B | Si | | |
| | 74.70% | 1.50% | 0.30% | 18.0% | 4.00% | 1.50% | | |

TABLE 2.

Additional Exemplary amorphous alloy compositions (atomic %)

| Alloy | Atm % | Atm % | Atm % | Atm % | Atm % | Atm % |
|---|---|---|---|---|---|---|
| 1 | Zr | Ti | Cu | Ni | Be | |
| | 41.20% | 13.80% | 12.50% | 10.00% | 22.50% | |
| 2 | Zr | Ti | Cu | Ni | Be | |
| | 44.00% | 11.00% | 10.00% | 10.00% | 25.00% | |
| 3 | Zr | Ti | Cu | Ni | Nb | Be |
| | 56.25% | 11.25% | 6.88% | 5.63% | 7.50% | 12.50% |
| 4 | Zr | Ti | Cu | Ni | Al | Be |
| | 64.75% | 5.60% | 14.90% | 11.15% | 2.60% | 1.00% |
| 5 | Zr | Ti | Cu | Ni | Al | |
| | 52.50% | 5.00% | 17.90% | 14.60% | 10.00% | |

TABLE 2.-continued

Additional Exemplary amorphous alloy compositions (atomic %)

| Alloy | Atm % | Atm % | Atm % | Atm % | Atm % | Atm % |
|---|---|---|---|---|---|---|
| 6 | Zr | Nb | Cu | Ni | Al | |
| | 57.00% | 5.00% | 15.40% | 12.60% | 10.00% | |
| 7 | Zr | Cu | Ni | Al | | |
| | 50.75% | 36.23% | 4.03% | 9.00% | | |
| 8 | Zr | Ti | Cu | Ni | Be | |
| | 46.75% | 8.25% | 7.50% | 10.00% | 27.50% | |
| 9 | Zr | Ti | Ni | Be | | |
| | 21.67% | 43.33% | 7.50% | 27.50% | | |
| 10 | Zr | Ti | Cu | Be | | |
| | 35.00% | 30.00% | 7.50% | 27.50% | | |
| 11 | Zr | Ti | Co | Be | | |
| | 35.00% | 30.00% | 6.00% | 29.00% | | |
| 12 | Zr | Ti | Fe | Be | | |
| | 35.00% | 30.00% | 2.00% | 33.00% | | |
| 13 | Au | Ag | Pd | Cu | Si | |
| | 49.00% | 5.50% | 2.30% | 26.90% | 16.30% | |
| 14 | Au | Ag | Pd | Cu | Si | |
| | 50.90% | 3.00% | 2.30% | 27.80% | 16.00% | |
| 15 | Pt | Cu | Ni | P | | |
| | 57.50% | 14.70% | 5.30% | 22.50% | | |
| 16 | Zr | Ti | Nb | Cu | Be | |
| | 36.60% | 31.40% | 7.00% | 5.90% | 19.10% | |
| 17 | Zr | Ti | Nb | Cu | Be | |
| | 38.30% | 32.90% | 7.30% | 6.20% | 15.30% | |
| 18 | Zr | Ti | Nb | Cu | Be | |
| | 39.60% | 33.90% | 7.60% | 6.40% | 12.50% | |
| 19 | Cu | Ti | Zr | Ni | | |
| | 47.00% | 34.00% | 11.00% | 8.00% | | |
| 20 | Zr | Co | Al | | | |
| | 55.00% | 25.00% | 20.00% | | | |

Other exemplary ferrous metal-based alloys include compositions such as those disclosed in U.S. Patent Application Publication Nos. 2007/0079907 and 2008/0305387. These compositions include the Fe(Mn, Co, Ni, Cu) (C, Si, B, P, Al) system, wherein the Fe content is from 60 to 75 atomic percentage, the total of (Mn, Co, Ni, Cu) is in the range of from 5 to 25 atomic percentage, and the total of (C, Si, B, P, Al) is in the range of from 8 to 20 atomic percentage, as well as the exemplary composition Fe48Cr15Mo14Y2C15B6. They also include the alloy systems described by Fe—Cr—Mo—(Y,Ln)-C—B, Co—Cr—Mo-Ln-C—B, Fe—Mn—Cr—Mo—(Y,Ln)-C—B, (Fe, Cr, Co)—(Mo,Mn)—(C,B)—Y, Fe—(Co,Ni)—(Zr,Nb,Ta)—(Mo,W)—B, Fe—(Al,Ga)—(P,C,B,Si,Ge), Fe—(Co, Cr,Mo,Ga,Sb)—P—B—C, (Fe, Co)—B—Si—Nb alloys, and Fe—(Cr—Mo)—(C,B)—Tm, where Ln denotes a lanthanide element and Tm denotes a transition metal element. Furthermore, the amorphous alloy can also be one of the exemplary compositions Fe80P12.5C5B2.5, Fe80P11C5B2.5Si1.5, Fe74.5Mo5.5P12.5C5B2.5, Fe74.5Mo5.5P11C5B2.5Si1.5, Fe70Mo5Ni5P12.5C5B2.5, Fe70Mo5Ni5P11C5B2.5Si1.5, Fe68Mo5Ni5Cr2P12.5C5B2.5, and Fe68Mo5Ni5Cr2P11C5B2.5Si1.5, described in U.S. Patent Application Publication No. 2010/0300148.

The amorphous alloys can also be ferrous alloys, such as (Fe, Ni, Co) based alloys. Examples of such compositions are disclosed in U.S. Pat. Nos. 6,325,868; 5,288,344; 5,368,659; 5,618,359; and 5,735,975, Inoue et al., Appl. Phys. Lett., Volume 71, p 464 (1997), Shen et al., Mater. Trans., JIM, Volume 42, p 2136 (2001), and Japanese Patent Application No. 200126277 (Pub. No. 2001303218 A). One exemplary composition is $Fe_{72}Al_5Ga_2P_{11}C_6B_4$. Another example is $Fe_{72}Al_7Zr_{10}Mo_5W_2B_{15}$. Another iron-based alloy system that can be used in the coating herein is disclosed in U.S. Patent Application Publication No. 2010/0084052, wherein the amorphous metal contains, for example, manganese (1 to 3 atomic %), yttrium (0.1 to 10 atomic %), and silicon (0.3 to 3.1 atomic %) in the range of composition given in parentheses; and that contains the following elements in the specified range of composition given in parentheses: chromium (15 to 20 atomic %), molybdenum (2 to 15 atomic %), tungsten (1 to 3 atomic %), boron (5 to 16 atomic %), carbon (3 to 16 atomic %), and the balance iron.

The amorphous alloy can also be one of the Pt- or Pd-based alloys described by U.S. Patent Application Publication Nos. 2008/0135136, 2009/0162629, and 2010/0230012. Exemplary compositions include Pd44.48Cu32.35Cu4.05P19.11, Pd77.5Ag6Si9P7.5, and Pt74.7Cu1.5Ag0.3P18B4Si1.5.

The aforedescribed amorphous alloy systems can further include additional elements, such as additional transition metal elements, including Nb, Cr, V, and Co. The additional elements can be present at less than or equal to about 30 wt %, such as less than or equal to about 20 wt %, such as less than or equal to about 10 wt %, such as less than or equal to about 5 wt %. In one embodiment, the additional, optional element is at least one of cobalt, manganese, zirconium, tantalum, niobium, tungsten, yttrium, titanium, vanadium and hafnium to form carbides and further improve wear and corrosion resistance. Further optional elements may include phosphorous, germanium and arsenic, totaling up to about 2%, and preferably less than 1%, to reduce melting point. Otherwise incidental impurities should be less than about 2% and preferably 0.5%.

In some embodiments, a composition having an amorphous alloy can include a small amount of impurities. The impurity elements can be intentionally added to modify the properties of the composition, such as improving the mechanical properties (e.g., hardness, strength, fracture mechanism, etc.) and/or improving the corrosion resistance. Alternatively, the impurities can be present as inevitable, incidental impurities, such as those obtained as a byproduct of processing and manufacturing. The impurities can be less than or equal to about 10 wt %, such as about 5 wt %, such as about 2 wt %, such as about 1 wt %, such as about 0.5 wt %, such as about 0.1 wt %. In some embodiments, these percentages can be volume percentages instead of weight percentages. In one embodiment, the alloy sample/composition consists essentially of the amorphous alloy (with only a small incidental amount of impurities). In another embodiment, the composition includes the amorphous alloy (with no observable trace of impurities).

In one embodiment, the final parts exceeded the critical casting thickness of the bulk solidifying amorphous alloys.

In embodiments herein, the existence of a supercooled liquid region in which the bulk-solidifying amorphous alloy can exist as a high viscous liquid allows for superplastic forming. Large plastic deformations can be obtained. The ability to undergo large plastic deformation in the supercooled liquid region is used for the forming and/or cutting process. As oppose to solids, the liquid bulk solidifying alloy deforms locally which drastically lowers the required energy for cutting and forming. The ease of cutting and forming depends on the temperature of the alloy, the mold, and the cutting tool. As higher is the temperature, the lower is the viscosity, and consequently easier is the cutting and forming.

Embodiments herein can utilize a thermoplastic-forming process with amorphous alloys carried out between Tg and Tx, for example. Herein, Tx and Tg are determined from standard DSC measurements at typical heating rates (e.g. 20° C./min) as the onset of crystallization temperature and the onset of glass transition temperature.

The amorphous alloy components can have the critical casting thickness and the final part can have thickness that is thicker than the critical casting thickness. Moreover, the time and temperature of the heating and shaping operation is selected such that the elastic strain limit of the amorphous alloy could be substantially preserved to be not less than 1.0%, and preferably not being less than 1.5%. In the context of the embodiments herein, temperatures around glass transition means the forming temperatures can be below glass transition, at or around glass transition, and above glass transition temperature, but preferably at temperatures below the crystallization temperature $T_X$. The cooling step is carried out at rates similar to the heating rates at the heating step, and preferably at rates greater than the heating rates at the heating step. The cooling step is also achieved preferably while the forming and shaping loads are still maintained.

Electronic Devices

The embodiments herein can be valuable in the fabrication of electronic devices using a BMG. An electronic device herein can refer to any electronic device known in the art. For example, it can be a telephone, such as a cell phone, and a land-line phone, or any communication device, such as a smart phone, including, for example an iPhone™, and an electronic email sending/receiving device. It can be a part of a display, such as a digital display, a TV monitor, an electronic-book reader, a portable web-browser (e.g., iPad™), and a computer monitor. It can also be an entertainment device, including a portable DVD player, conventional DVD player, Blue-Ray disk player, video game console, music player, such as a portable music player (e.g., iPod™), etc. It can also be a part of a device that provides control, such as controlling the streaming of images, videos, sounds (e.g., Apple TV™), or it can be a remote control for an electronic device. It can be a part of a computer or its accessories, such as the hard drive tower housing or casing, laptop housing, laptop keyboard, laptop track pad, desktop keyboard, mouse, and speaker. The article can also be applied to a device such as a watch or a clock.

Injection compression molding (also known as coining) is utilized to process amorphous alloys. Such a forming process involves the injection of molten amorphous alloy into a die cavity, followed by the application of additional pressure within the die to reduce the thickness or add additional features to the alloy during filling and solidification. This process allows the production of very thin or high aspect ratio structures which might otherwise not be possible due to the simultaneous requirements of complete filling and rapid cooling associated with casting of amorphous alloys. In addition, this process will improve casting yield by maintaining good heat transfer from the solidifying alloy to the cavity walls, and it can also be used to improve the as-cast surface finish of cast articles by eliminating flow defects, sinks, etc.

An advantage of the embodiments is that a separate of portion of the mold tooling that actuates during the fill or immediately after the fill to change the volume or shape of the cavity to influence the part thickness, surface finish and degree of fill. Normally, on cooling during molding, the part shrinks and creates a gap between the mold wall and the part, which minimizes heat transfer. By the method of this invention, one can maintain a constant contact between the mold wall and the part during cooling, there maintaining rapid heat transfer and thereby allow the part to be formed as a bulk amorphous part.

An embodiment relates to a method of forming a BMG article comprising providing a mold comprising a stationary mold part and a movable mold part paired to form a mold cavity; forming the mold cavity between the stationary mold part and the movable mold part; injecting a molten material into the mold cavity; cooling the molten material to form a bulk metallic glass (BMG) article at a cooling rate in the mold cavity; and moving the movable mold part while injecting and/or cooling to prevent substantially any loss of physical contact between the molten material.

Optionally, the moving the movable mold part comprises controlling: a pressure applied on the movable mold part, timing for applying the pressure, moving speed of the movable mold part, degree of filling of the molten material in the mold cavity, or a combination thereof. Optionally, the moving the movable mold part comprises applying a pressure on the movable mold part to reduce or increase a thickness of the molten material in the mold cavity, while injecting and/or cooling the molten material. Optionally, the moving the movable mold part comprises applying a pressure on the movable mold part to add additional structural features in the BMG article, while injecting and/or cooling the molten material. Optionally, the additional structural features in the BMG article comprises a circle feature. Optionally, the moving the movable mold part comprises applying a pressure in a direction normal to a surface of the movable mold part to move the movable mold part toward and away from the stationary mold part. Optionally, the moving the movable mold part comprises applying a pressure in a direction parallel to a surface of the movable mold part to impart additional features to the BMG article. Optionally, no gap is formed between interior surfaces of the mold cavity and the molten material in the mold cavity. Optionally, the cooling the molten material in the mold cavity further comprises selecting a mold material, a temperature of the mold, an atmosphere in the mold, a temperature of the molten material, or a combination thereof to control the cooling rate. Optionally, the cooling rate is maintained at about a critical cooling rate or greater, wherein the critical cooling rate is in the range from 0.1 K/s to 1000 K/s, preferably less than 500 K/s, more preferably less than 100 K/s and most preferably less than 10 K/s. Optionally, the molten material comprises a Zr-based, Fe-based, Ti-based, Pt-based, Pd-based, gold-based, silver-based, copper-based, Ni-based, Al-based, Mo-based, Co-based alloy, or combinations thereof. Optionally, the BMG article is formed maintaining edges of the article without an undefiled part. Optionally, the moving comprises substantially entirely filling the mold cavity with the molten material. Optionally, the method further comprises additional structural features in the BMG article.

Another embodiment relates to a BMG article made by the process of described above. The article could comprise a plurality of sub-structures. Optionally, at least a portion of the BMG article has a thickness that is greater than a critical casting thickness of the BMG alloy of the BMG article. Optionally, the BMG article comprises a cylindrical rod with an aspect ratio of greater than 10. Optionally, the BMG article has a measurement of at least 0.5 mm in all dimensions, and more preferably a measure of at least 1.0 mm in all dimensions. Optionally, the BMG article comprises an object with an aspect ratio (first dimension/second dimension) of 10 or more.

Another embodiment relates to an injection compression molding apparatus comprising a mold comprising a stationary mold part and a movable mold part paired to form a mold cavity; an injection unit configured to inject a molten material into the mold cavity, wherein the molten material is cooled into a BMG article at a cooling rate; and an unit configured to control movement of the movable mold part while the molten material is injected and/or cooled at the cooling rate in the mold cavity. Optionally, the apparatus is configured to mold an article comprising a BMG alloy.

Various embodiments relate to improving the processability of forming BMG articles by incorporating injection compression molding, such that, for example, (1) a heat transfer can be provided between the molten material and interior surfaces of the mold to maintain a desired cooling rate to form the article in an amorphous state; (2) the mold cavity can be substantially entirely filled with the molten material without forming a gap there-between; and/or (3) the formed BMG article is capable of having an aspect ratio of at least about 10 or less than about 0.1 to form small sections, or thin structures, e.g., thin inflections. In addition, the BMG article can be formed with desired surface finishes and structural features.

In accordance with various embodiments, there is provided a method of forming a BMG article using a mold. The mold may include a stationary mold part and a movable mold part paired to form a mold cavity. Once the mold cavity is formed, a molten material can be injected to fill the mold cavity. The molten material in the mold cavity can then be cooled into a bulk metallic glass (BMG) article at a desired cooling rate. While injecting and/or cooling the molten material, the movement of the movable mold part can be controlled to maintain a thermal contact between the molten material and the mold and thus to maintain the cooling rate. In embodiments, while injecting and/or cooling the molten material, the movement of the movable mold part can be controlled such that at least a portion of the formed BMG article has an aspect ratio of at least 10 or less than 0.1. In embodiments, while injecting and/or cooling the molten material, the movement of the movable mold part can be controlled to add additional structural features in the BMG article.

In accordance with various embodiments, there is provided an injection compression molding apparatus. The apparatus may include a mold, an injection unit, and/or a mechanical unit. The mold may include a stationary mold part and a movable mold part paired to form a mold cavity. The injection unit can be configured to inject a molten material into the mold cavity such that the molten material can be cooled into a BMG article at a desired cooling rate in the mold cavity. The mechanical unit can be configured to control movement of the movable mold part while the molten material is injected and cooled in the mold cavity.

In an exemplary embodiment, the method of forming a BMG article involves the injection of molten amorphous alloy into a mold cavity (e.g., a die cavity), followed by application of additional pressure within the mold (e.g., die) to reduce/increase the thickness and/or add additional features to the alloy during filling and solidification. The separation of portion of the mold tooling actuates, during the filling and/or immediately after the filling, to change the volume or shape of the mold cavity to partially or wholly influence thickness, surface finish, and/or degree of the filling of the article or their parts. This process allows the production of very thin or high aspect ratio structures which might otherwise not be possibly to form due to the simultaneous requirements of substantially complete filling and rapid cooling associated with casting of amorphous alloys. In addition, this process will improve casting yield by maintaining desired heat transfer from the solidifying alloy to the cavity walls, and it can also be used to improve the as-cast surface finish of cast articles by eliminating flow defects, sinks, etc. Normally, on cooling during molding, the articles or parts thereof shrink and create a gap between the mold wall and the part, which minimizes heat transfer. As disclosed herein, one can maintain a constant contact between the mold wall and the parts of the article during cooling, maintaining rapid heat transfer and thereby allow the molten material to be formed as a bulk amorphous article.

Apparatus and Methods

The apparatus, methods, techniques, and devices illustrated herein are not intended to be limited to the illustrated embodiments. As further described below, parts of the apparatus are positioned in-line with each other. In accordance with some embodiments, parts of the apparatus (or access thereto) are aligned on a horizontal axis, although the parts of the apparatus can also be aligned on a vertical axis. The following embodiments are for illustrative purposes only and are not meant to be limiting.

Figure 3:
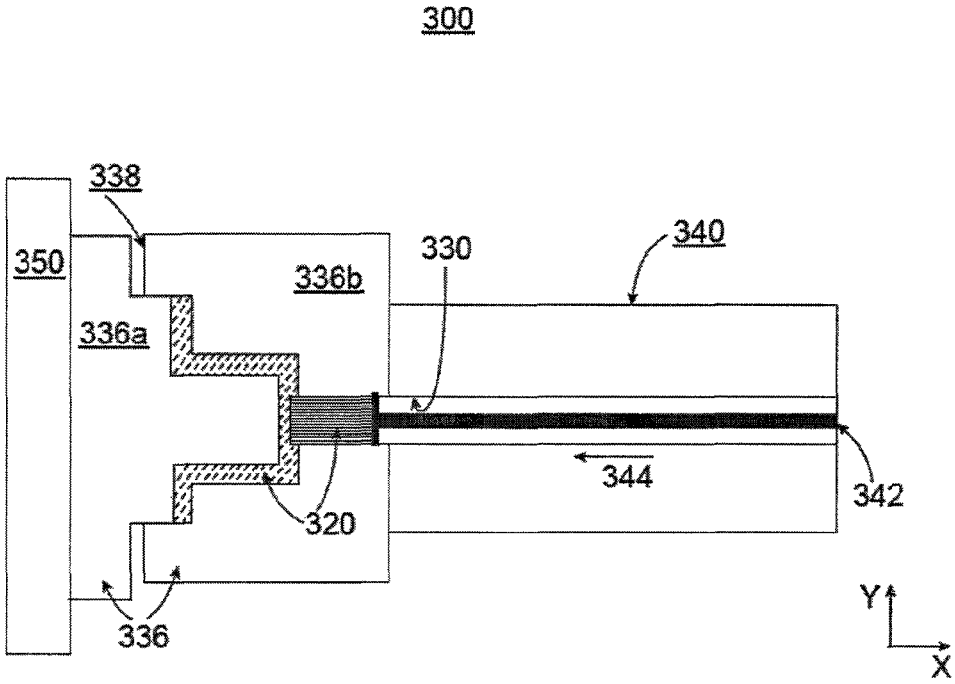
FIG. 3 is a schematic showing an exemplary injection compression molding apparatus in accordance with various embodiments of the present teachings.
Figure 4:
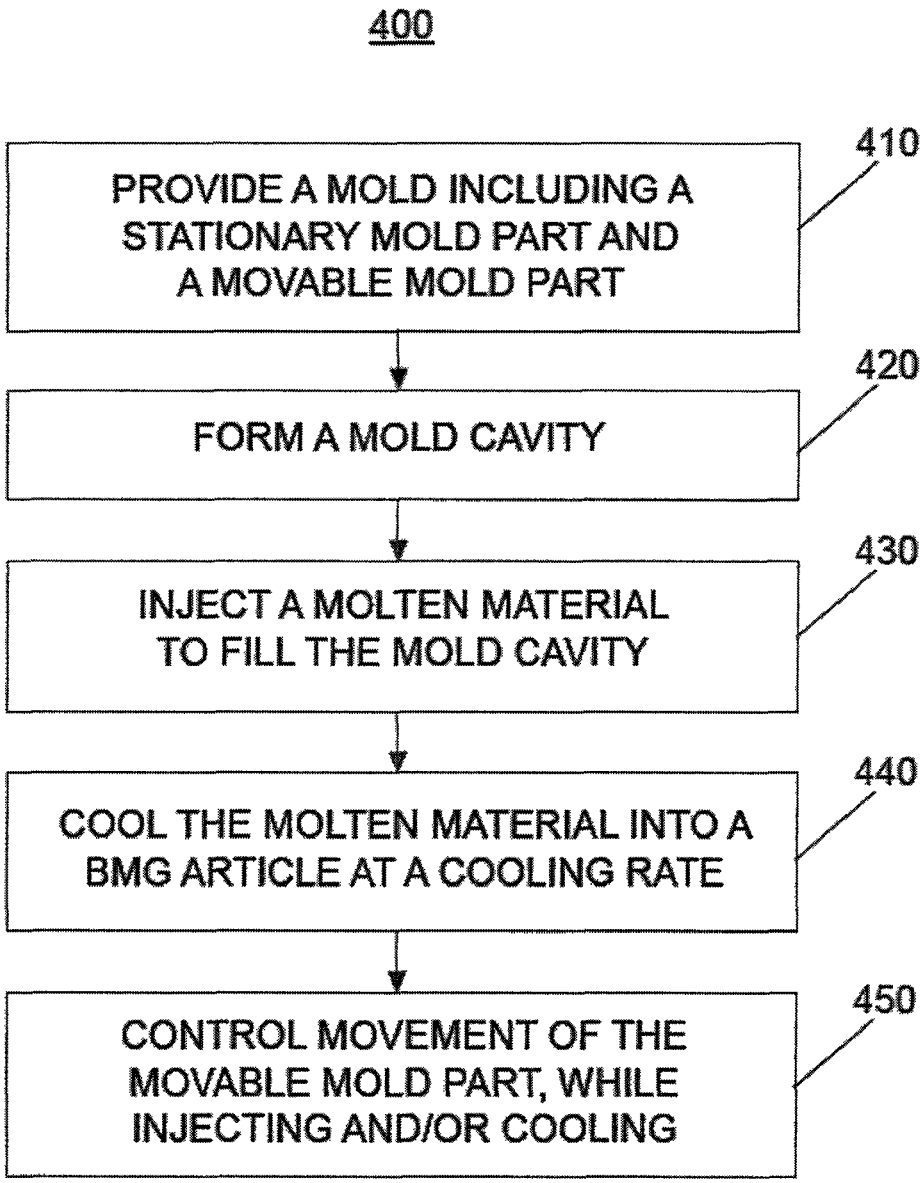
FIG. 4 is a flow diagram illustrating an exemplary method for forming a BMG article in accordance with various embodiments of the present teachings.

FIG. 3 is a schematic showing an exemplary injection compression molding apparatus 300 in accordance with various embodiments of the present teachings. FIG. 4 is a flow diagram illustrating an exemplary method for forming a BMG article in accordance with various embodiments of the present teachings. Note that the method depicted in FIG. 4 is described herein with respect to the apparatus shown in FIG. 3, although one of ordinary skill in the art will appreciate that the methods and the apparatus are not limiting in any manners.

As shown, the apparatus 300 in FIG. 3 can include, e.g., an injection unit 340, a mold 336, and a mechanical unit 350.

The injection unit 340 can be configured to inject a molten material, e.g., a metal alloy ingot 320, into a mold cavity 338. In one embodiment, under vacuum condition, one or multiple charges of molten metal alloys may be transferred, e.g., from a melt chamber or a crucible, to a transfer sleeve 330 of apparatus 300 to at least partially fill the transfer sleeve and then injected into the mold cavity 338. For example, the crucible may be mounted for translation and for pivotal movement about a pouring axis, and in turn is mounted to a motor for rotating the crucible to pour molten material from the crucible through a pour hole of the transfer sleeve 330, with or without a pour cup or funnel coupled to the sleeve. In other embodiments, translation may occur from a melt chamber in which metal alloys are melted to a position in a vacuum chamber in which the transfer sleeve is located. Transfer sleeve 330 (sometimes referred to as a shot sleeve, a cold sleeve or an injection sleeve in the art and herein) may be provided between a melt zone (not shown) and the mold 336. Transfer sleeve 330 has an opening that is configured to receive and allow transfer of the molten material therethrough and into mold 336. Its opening may be provided in a horizontal direction along the horizontal axis (e.g., X axis). The transfer sleeve need not be a cold chamber.

Molten materials can be provided, e.g., by melting metal alloys, e.g., in a non-reactive environment, to prevent any reaction, contamination or other conditions which might detrimentally affect the quality of the resulting BMG articles. The metal alloys may be melted in a vacuum environment or in an inert environment, e.g., argon. In some cases, since any gasses in the melting environment may become entrapped in the molten material and result in excess porosity in cast article, the metal alloys may be melted in a vacuum environment. For example, a melt chamber may be coupled to a vacuum source in which metal alloys are melted in a melt chamber. In embodiments, single charges or multiple charges of materials at once may be melted.

The melting of metal alloys can have a starting material in any number of forms, e.g., in a form of an ingot (solid state), a semi-solid state, a slurry that is preheated, powder, pellets, etc. In embodiments, the molten metal alloys may be an inductively melted metal alloy. For example, metal alloys may be melted using an induction skull remelting or melting (ISR) unit, or using other manners, such as by vacuum induction melting (VIM), electron beam melting, resistance melting or plasma arc, etc. Once one or several charges of metal alloys are melted in a vacuum environment, the molten metal alloys are then transferred into the transfer sleeve 330 for injection into the mold cavity 338.

In one example, when induction skull remelting or melting (ISR) is used to melt the metal alloys, for example in a crucible which is capable of rapidly, cleanly melting a single charge of material to be cast, e.g., up to about 25 pounds of material. In ISR, material is melted in the crucible defined a plurality of metal (e.g., copper) fingers retained in position next to one another. The crucible is surrounded by an induction coil coupled to a power source. The fingers include passages for the circulation of cooling water from and to a water source to prevent melting of the fingers. The field generated by the coil passes through the crucible, and heats and melts metal alloy material located in the crucible. The field also serves to agitate or stir the molten metal alloys. A thin layer of the material freezes on the crucible wall and forms the skull, thereby minimizing the ability of molten material to attack the crucible. By properly selecting the crucible and coil, and the power level and frequency applied to the coil, it is possible to urge the molten material away from the crucible, in effect levitating the molten material.

Since some amount of time will necessarily elapse between material melting and injection of the molten material, the material is melted at a temperature high enough to ensure that the material remains at least substantially molten until it is injected, but low enough to ensure that solidification occurs at desired cooling rate to form BMG articles. In the case that a relative low temperature is used, transfer and injection of molten metal must be rapid enough prior to metal solidification in the mold cavity.

When injecting the molten material ingot 320, a plunger rod 342 or a similar device, cooperates with the transfer sleeve 330 and hydraulics or other suitable assembly to drive and move the plunger rod 342 in the direction of arrow 344, to inject the molten metal alloy ingot 320 from the transfer sleeve 330 into the mold cavity 338. In embodiments, the plunger rod may be controlled having a speed of between about 30 inches per second (ips) and 500 ips, or between about 50 ips and 175 inches per second (ips). The plunger rod may be moved at a pressure of at least about 1000 psi or at least 1500 psi. In embodiments, the ingot may be hot isostatically pressed (HIP'd) to reduce and substantially eliminate porosity in the articles as cast.

As the plunger rod 342 approaches the ends of its stroke to fill the mold cavity 338, the plunger rod 342 begins to transfer pressure to the molten alloys 320. Intensification is also performed to minimize porosity, and to reduce or eliminate any material shrinkage during the subsequent cooling. Once the mold cavity is filled, the pressure may be maintained until the casting of the molten metal alloys solidifies.

During the process, the transfer sleeve and/or related devices may be heated at certain temperatures according to the temperature of the molten metal alloys. Alternatively, no heat may be applied. In this case, the process including transferring and/or injection of molten metal alloys may be conducted within a few seconds. For example, the injection may occur in less than 3 seconds or less than 2 seconds.

In an embodiment, at least plunger rod 342 and melt zone 310 are provided in-line and on a horizontal axis (e.g., X axis), such that plunger rod 342 is moved in a horizontal direction (e.g., along the X-axis) to move the molten material 320 into mold 336. The mold can be positioned adjacent to the melt zone of the injection unit 340.

The mold 336 has an inlet for receiving molten material there-through. Systems or apparatus 300 that are used to mold materials such as metals or alloys may implement a vacuum when forcing molten material into a mold or mold cavity. The vacuum pressure (e.g., by a vacuum source) may be applied to at least the parts of the apparatus 300 used to melt, move or transfer, and mold the material therein. For example, the mold 336, transfer sleeve 330, and plunger rod 342 may all be under vacuum pressure and/or enclosed in a vacuum chamber.

The mold 336 can include a movable mold part 336*a* and a stationary mold part 336*b*. The movable mold part 336*a* and the stationary mold part 336*b* may be paired and cooperated to define a mold cavity 338. The movable mold part 336*a* and the stationary mold part 336*b* may be reusable. The mold cavity 338 may include one or more cavity shapes to produce one article (e.g., BMG article). In embodiments, more than one mold cavities can be configured in the apparatus 300 to form more than one BMG articles at the same time.

As disclosed herein, the movable mold part 336*a* can be controllably movable relative to the stationary mold part 336*b*. For example, the movable mold part 336*a* can be controllably moved toward or away from the stationary mold part 336*b*.

Controlling movement of the movable mold part can include, e.g., controlling one or more of a pressure applied on the movable mold part, timing for applying the pressure, moving speed of the movable mold part (e.g., and thus the filling and spreading speed of the molten material in the mold cavity), filling degree in the mold cavity, etc. The pressure can be applied in a direction (X-axis) perpendicular to a surface of the movable mold part to cause the movable mold part to move toward and away from the stationary mold part, and/or in a direction parallel to the surface of the movable mold part (e.g., Z-axis, not shown in FIG. 3) such that desired features can be applied to the material in the mold cavity through the movable mold part. Controlling movement of the movable mold part can be performed while the injection unit is injecting the molten material into the mold cavity and/or while the injected material in the molding cavity is cooling and solidifying.

In embodiments, a mechanical unit 350 can be used to control the movement of the movable mold part. The mechanical unit 350 can be any mechanical mechanism associated with the movable mold part 336*a* and/or the stationary mold part 336*b*. For example, the mechanical unit 350 can be a hydraulic assembly, a mold clamping unit, a compression mechanism, an actuator such as an oil pressure actuator, etc. In operation, as the molten material, e.g., the metal alloy, fills the mold cavity, contacts the cavity walls, and may be still soft, a force or pressure may be, e.g., continuously, applied to the molten material by the mechanical unit, e.g., to overcome shrinkage of the molten material when it gets cooled and solidified against the cavity walls.

The injected molten material 320 can be solidified against the interior surfaces of the mold cavity 338. Solidification of the molten metal alloy 320 to from BMG article may involve a cooling rate to ensure that the molten metal alloys are cooled to form a BMG (i.e., bulk-solidifying amorphous alloy) article in an amorphous state. For example, the cooling rate may be greater than or equal to a critical cooling rate of the material. In one embodiment, the critical cooling rate may be no more than about 500 K/s, for example, in the range of from about 5 K/s to about 500 K/s or from about 5 K/s to about 400 K/s, or from about 5 K/s to about 300 K/s, or from about 5 K/s to about 200 K/s, or less than 10 K/s.

The cooling rate of the molten metal alloys to form a BMG article has to such that the time-temperature profile during cooling does not traverse through the nose-shaped region bounding the crystallized region in the TTT diagram of FIG. 2. Also, amorphous metals/alloys can be produced with cooling rates high (rapid) enough, e.g., higher than the critical cooling rate, to allow formation of amorphous materials, and low enough to allow formation of amorphous structures in thick layers—e.g., for bulk metallic glasses (BMG). Zr-based alloy systems including different elements, may have lower critical cooling rates of less than 103° C./sec, and thus they have much larger critical casting thicknesses than their counterparts. In embodiments, in order to achieve a cooling rate higher than the critical cooling rate, heat has to be extracted from the sample.

In embodiments, the cooling rate is controlled by, e.g., the materials used for one or both the mold parts 336*a-b*, temperature of the mold material, atmosphere within the mold cavity (e.g., in an inert gas such as Ar, He, etc.), temperature of the molten material 320 in the mold cavity 338.

The mold can be formed of various materials, and should have good thermal conductivity, and be relatively resistant to erosion and chemical attack from injection of the molten materials such as metal alloys. A comprehensive list of possible materials may be quite large, and may include materials such as metals, ceramics, graphite and metal matrix composites. Non-limiting examples of mold materials may include tool steels such as H13 and V57, molybdenum and tungsten based materials such as TZM and Anviloy, copper based materials such as copper beryllium alloy "Moldmax"-high hardness, cobalt based alloys such as F75 and L605, nickel based alloys such as IN 100 and Rene 95, iron base alloys and mild carbon steels such as 1018. Selection of the mold material is critical to producing articles economically, and depends upon the complexity and quantity of the article being cast, as well as on the current cost of the component. Each mold material has attributes that makes it desirable for different applications. For low cost die materials, mild carbon steels and copper beryllium alloys may be used due to their relative ease of machining and fabricating the mold. Refractory metal such as tungsten and molybdenum based materials may be used for higher cost, higher volume applications due to their good strength at higher temperatures. Cobalt based and nickel based alloys and the more highly alloyed tool steels may offer a compromise between these two groups of materials.

The mold cavity 338 may be a cold chamber-type mold cavity. The mold 336 may also be attached to a source of coolant such as water or a source of heat such as oil to thermally manage the temperature of the mold during the cooling operation.

During molding of the material, one or both the mold parts 336*a-b* can be configured to substantially eliminate exposure of the material (e.g., amorphous alloy) there-between, e.g., to oxygen, air or other reactive gases. In embodiments, inert gases, e.g., Ar, He, etc. can be used in the mold 336 to manage the cooling rate of the molten material within the mold cavity such that the molten material is cooled into a BMG material in the mold cavity. Alternatively, a vacuum may be applied such that atmospheric air is substantially eliminated from within the mold and their cavities. A vacuum pressure is applied to an inside of vacuum mold using, e.g., a vacuum source. For example, the vacuum pressure or level on the system can be held between $1\times10^{-1}$ to $1\times10^{-4}$ Torr during the melting and subsequent molding cycle. In another embodiment, the vacuum level is maintained between $1\times10^{-2}$ to about $1\times10^{-4}$ Torr during the melting and molding process. Of course, other pressure levels or ranges may be used, such as $1\times10^{-9}$ Torr to about $1\times10^{-3}$ Torr, and/or $1\times10^{-3}$ Torr to about 0.1 Torr.

In one embodiment, before or during injection, the movable mold part 336*a* can be controllably moved away from the stationary mold part 336*b*, by the mechanical unit 350, to create a relatively large cavity for receiving the molten material 320. As the molten material 320 is pushed into the mold cavity 338 by the plunger rod 342 from one side, e.g., of the stationary mold part 336*b*, the molten material 320 can also be pushed from the other side, e.g., of the movable mold part 336*a*.

Various embodiments also include methods for forming the BMG article. For example, as depicted in FIG. 4. At block 410, a mold 336 including a stationary mold part 336*b* and a movable mold part 336*a* can be provided; at block 420, a mold cavity 338 can be formed as desired between the stationary mold part 336*b* and the movable mold part 336*a*; at block 430, a molten material 320 can be injected into the mold cavity 338; at block 440, the molten material can be cooled into a BMG article at a desired cooling rate; at block 450, while injecting and/or cooling, movement of the movable mold part 336*a* can be controlled as disclosed herein, e.g. by controlling a pressure on the movable mold part 336*a*, timing for applying the pressure on the movable mold part 336*a*, speed of the movable mold part, etc.

By controlling movement of the movable mold part 336*a*, e.g., adjusting the pressure, timing to apply pressure, speed, etc. on the movable mold part 336*a* using the mechanical unit 350, size of the mold cavity 338 for containing the molten material 320 can be adjusted, the molten material can substantially completely fills the entire cavity for molding without generating gaps between the metal alloy and the interior surfaces of the mold cavity such that the molded article can have desired structures and surface finishes according to the cavity. The use of the mechanical unit 350 can maintain the edge of the formed article, i.e., to avoid an underfilled part thereof, impart fine structural features to the pointing process, and/or improve the surface finish. For example, the injection compress molding can allow the molded material to mirror a polished cavity surface more consistently than an injection molding process without compression by the mechanical unit 350.

During cooling process of the molten material 320, the solidified molten material may shrink to some extent to generate a gap between the molded material (that may include solidified material and/or molten material) and the interior surfaces of the mold cavity to reduce thermal contact or heat transfer there-between, which may affect (e.g., reduce) the cooling rate of the molded material. To maintain the cooling rate of the molded material in the desired range for forming amorphous alloy, the mechanical unit 350 can be used to adjust the pressure, time, speed, etc. on the movable mold part 336*a* to maintain the thermal contact or heat transfer there-between. The molded material can then be rapidly cooled at a desired cooling rate to from an amorphous base on the interior surfaces of the mold cavity, instead of forming a crystalline base thereon.

In embodiments, it is desirable to form BMG articles having high aspect ratio, small sections, or thin structures by using cavities with thin structures. In some cases when a thin cavity is used, it should be filled in the beginning of the filling process. However, by using the apparatus 300 in FIG. 3 and methods in FIG. 4, there is no need for filling the thin cavities first. The mechanical unit 350 can adjust the filling of the molten material in the cavity(ies) to spread the molten material before it solidifies on the interior surfaces of the cavity. For example, one or more portions/parts of the formed BMG article, or the BMG article itself may include a rod such as a cylindrical rod with an aspect ratio of greater than about 10, or greater than about 100, or greater than about 1000. In another example, one or more portions/parts of the formed BMG article, or the BMG article itself may include an object such as a disc-shaped object with an aspect ratio (height/diameter) of less than about 0.1, or less than about 0.01, or less than about 0.001.

In embodiments, the mechanical unit 350 can be used to impart certain features/surface features onto the molded material and thus the final BMG article. That is, rather than to fill the mold cavity with the molten alloy and to mirror the surface features of the mold cavity to the molded material, the mechanical unit 350 can be actuated to apply pressure to the molded material and impart certain structural features, e.g., circle features or other suitable features, in the molded material, the BMG article.

In embodiments, at least one portion/part of the BMG article can have a thickness that is greater than the critical casting thickness. For example, the BMG article can have a measurement of at least 0.5 mm in all dimensions.

The formed BMG articles may have various three dimensional (3D) structures as desired, including, but not limited to, flaps, teeth, deployable teeth, deployable spikes, flexible spikes, shaped teeth, flexible teeth, anchors, fins, insertable or expandable fins, anchors, screws, ridges, serrations, plates, rods, ingots, discs, balls and/or other similar structures.

Metal alloys used for forming BMG articles may be Zr-based, Fe-based, Ti-based, Pt-based, Pd-based, gold-based, silver-based, copper-based, Ni-based, Al-based, Mo-based, Co-based alloys, and the like, and combinations thereof. For example, Zr-based alloys may include any alloys (e.g., BMG alloys or bulk-solidifying amorphous alloys) that contain Zr. In addition to containing Zr, the Zr-based alloys may further include one or more elements selected from, Hf, Ti, Cu, Ni, Pt, Pd, Fe, Mg, Au, La, Ag, Al, Mo, Nb, Be, or any combinations of these elements, e.g., in its chemical formula or chemical composition. The elements can be present at different weight or volume percentages. In embodiments, the Zr-based alloys may be free of any of the aforementioned elements to suit a particular purpose. For example, in some embodiments, the Zr-based metal alloys, or the composition including the Zr-based metal alloys, may be substantially free of nickel, aluminum, titanium, beryllium, and/or combinations thereof. In one embodiment, the Zr-based metal alloy, or the composition including the Zr-based metal alloy may be completely free of nickel, aluminum, titanium, beryllium, and/or combinations thereof.

Exemplary Zr-based BMG alloys may be Zr—Ti—Ni—Cu based amorphous alloy, e.g., having the formula (Zr, Ti)a (Ni, Cu, Fe)b(Be, Al, Si, B)c; (Zr, Ti)a(Ni, Cu)b(Be)c; and/or (Zr)a(Nb, Ti)b(Ni, Cu)c(Al)d as previously described in this application. Exemplary Zr-based BMG alloys may be Zr—Al based amorphous alloy, for example, having about 60% zirconium and about 38% copper by weight or by volume, with the rest of aluminum and nickel. In some embodiments, examples of Zr-based BMG alloys may include those listed in Table 2.

Referring back to FIGS. 3-4, BMG article(s) can be ejected from the mold 336, after a sufficient period of time has elapsed to ensure solidification of the metal alloys to form one or more BMG articles. An ejector mechanism (not shown) can be configured to eject molded BMG article or the molded part from the mold cavity between the mold parts 336*a*-*b*. The ejection mechanism can be associated with or connected to an actuation mechanism (not shown) that is configured to be actuated in order to eject the BMG articles (e.g., after the mold parts 336*a*-*b* are moved e.g., horizontally, and relatively away from each other, after related vacuum pressure is released). In embodiments, any number or types of molds may be employed for the apparatus 300 and the method 400. For example, any number of pairs of mold parts may be provided between and/or adjacent the mold parts 336*a*-*b* to form the molds.

While the invention is described and illustrated here in the context of a limited number of embodiments, the invention may be embodied in many forms without departing from the spirit of the essential characteristics of the invention. The illustrated and described embodiments, including what is described in the abstract of the disclosure, are therefore to be considered in all respects as illustrative and not restrictive. The scope of the invention is indicated by the appended claims rather than by the foregoing description, and all changes that come within the meaning and range of equivalency of the claims are intended to be embraced therein.

What is claimed is:

1. A method of forming a bulk metallic glass (BMG) article comprising:

providing a mold comprising a stationary mold part and a movable mold part paired to form a mold cavity;

forming the mold cavity between the stationary mold part and the movable mold part;

injecting a molten material into the mold cavity;

cooling the molten material to form the (BMG) article at a cooling rate in the mold cavity; and wherein the movable mold part is moved while said injecting and said cooling to prevent substantially any loss of physical contact between the molten material and the movable mold part during said injecting and said cooling.

2. The method of claim 1, wherein the moving the movable mold part comprises: controlling a pressure applied on the movable mold part, timing for applying the pressure, moving speed of the movable mold part, degree of filling of the molten material in the mold cavity, or a combination thereof.

3. The method of claim 1, wherein the moving the movable mold part comprises applying a pressure on the movable mold part to reduce or increase a thickness of the molten material in the mold cavity, while said injecting and said cooling the molten material.

4. The method of claim 1, wherein the moving the movable mold part comprises applying a pressure on the movable mold part to add additional structural features in the BMG article, while said injecting and said cooling the molten material.

5. The method of claim 4, wherein the additional structural features in the BMG article comprises a circle feature.

6. The method of claim 1, wherein the moving the movable mold part comprises applying a pressure in a direction normal to a surface of the movable mold part to move the movable mold part toward and away from the stationary mold part.

7. The method of claim 1, wherein the moving the movable mold part comprises applying a pressure in a direction parallel to a surface of the movable mold part to impart additional features to the BMG article.

8. The method of claim 1, wherein no gap is formed between interior surfaces of the mold cavity and the molten material in the mold cavity.

9. The method of claim 1, wherein the cooling the molten material in the mold cavity further comprises: selecting a mold material, a temperature of the mold, an atmosphere in the mold, a temperature of the molten material, or a combination thereof, to control the cooling rate.

10. The method of claim 1, wherein the cooling rate is maintained at about a critical cooling rate or greater, wherein the critical cooling rate is no more than about 500 K/s.

11. The method of claim 1, wherein the cooling rate is maintained at less than 10 K/s.

12. The method of claim 1, wherein the molten material comprises a Zr-based, Fe-based, Ti-based, Pt-based, Pd-based, gold-based, silver-based, copper-based, Ni-based, Al-based, Mo-based, Co-based alloy, or combinations thereof.

13. The method of claim 1, wherein the BMG article is formed maintaining edges of the article without an undefiled part.

14. The method of claim 1, wherein the moving comprises substantially entirely filling the mold cavity with the molten material.

15. The method of claim 1, further comprising additional structural features in the BMG article.

16. A method of forming a bulk solidifying amorphous alloy article comprising:

injecting a molten material into a mold cavity; the mold cavity being between a stationary mold part and a movable mold part paired to form the mold cavity cooling the molten material to form the bulk solidifying amorphous alloy article having a minimum thickness of at least 0.5 mm at a cooling rate in the mold cavity; and wherein the movable mold part is moved while said injecting and said cooling to prevent substantially any loss of physical contact between the molten material and the movable mold part during said injecting and said cooling.

17. The method of claim 16, wherein the moving the movable mold part comprises: controlling a pressure applied on the movable mold part, timing for applying the pressure, moving speed of the movable mold part, degree of filling of the molten material in the mold cavity, or a combination thereof.

18. The method of claim 16, wherein the moving the movable mold part comprises applying a pressure on the movable mold part to reduce or increase a thickness of the molten material in the mold cavity, while said injecting and said cooling the molten material.

19. The method of claim 16, wherein the moving the movable mold part comprises applying a pressure on the movable mold part to add additional structural features in the BMG article, while said injecting and said cooling the molten material.

20. The method of claim 16, wherein the moving the movable mold part comprises applying a pressure in a direction normal or parallel to a surface of the movable mold part.

21. The method of claim 16, wherein no gap is formed between interior surfaces of the mold cavity and the molten material in the mold cavity.

22. The method of claim 16, wherein the cooling the molten material in the mold cavity further comprises: selecting a mold material, a temperature of the mold, an atmosphere in the mold, a temperature of the molten material, or a combination thereof, to control the cooling rate.

23. The method of claim 16, wherein the cooling rate is maintained at about a critical cooling rate or greater, wherein the critical cooling rate is no more than about 500 K/s.

* * * * *